US008944179B2

(12) United States Patent
Ukai et al.

(10) Patent No.: US 8,944,179 B2
(45) Date of Patent: Feb. 3, 2015

(54) POWER TOOL

(75) Inventors: Tomohiro Ukai, Anjo (JP); Yuta Matsuura, Anjo (JP); Takamasa Hanai, Anjo (JP); Junpei Kamimoto, Anjo (JP); Akihiro Ito, Anjo (JP)

(73) Assignee: Makita Corporation, Anjo-shi (JP)

( * ) Notice: Subject to any disclaimer, the term of this patent is extended or adjusted under 35 U.S.C. 154(b) by 555 days.

(21) Appl. No.: 13/333,164

(22) Filed: Dec. 21, 2011

(65) Prior Publication Data

US 2012/0175139 A1 Jul. 12, 2012

(30) Foreign Application Priority Data

Dec. 27, 2010 (JP) ..... 2010-290455

(51) Int. Cl.
*B25B 21/00* (2006.01)
*B25F 5/00* (2006.01)
*B25B 23/00* (2006.01)

(52) U.S. Cl.
CPC ..... *B25B 21/008* (2013.01); *B25F 5/001* (2013.01); *B25B 21/00* (2013.01); *B25B 23/0064* (2013.01)
USPC ..... 173/2; 173/178; 173/217

(58) Field of Classification Search
USPC ..... 173/2, 176, 178, 181, 217; 81/57.14, 81/429, 467, 469, 470
See application file for complete search history.

(56) References Cited

U.S. PATENT DOCUMENTS 4,721,169 A * 1/1988 Nagasawa et al. ..... 173/178
5,094,133 A * 3/1992 Schreiber ..... 81/474
5,154,242 A * 10/1992 Soshin et al. ..... 173/178
5,310,010 A * 5/1994 Lo ..... 173/178
5,360,073 A 11/1994 Akazawa
5,524,512 A * 6/1996 Wolfe ..... 81/429
5,738,177 A * 4/1998 Schell et al. ..... 173/178
5,918,685 A * 7/1999 Ulbrich et al. ..... 173/4
6,257,351 B1 * 7/2001 Ark et al. ..... 173/178
6,520,270 B2 * 2/2003 Wissmach et al. ..... 173/170
6,742,601 B2 * 6/2004 Numata ..... 173/217
6,910,540 B2 * 6/2005 Totsu ..... 173/178
7,007,762 B2 * 3/2006 Yamamoto ..... 173/1

(Continued)

FOREIGN PATENT DOCUMENTS

JP A-58-160063 9/1983
JP A-5-253854 10/1993

(Continued)

OTHER PUBLICATIONS

Aug. 13, 2014 Search Report issued in European Patent Application No. 11 195 480.6.

(Continued)

*Primary Examiner* — Scott A. Smith
(74) *Attorney, Agent, or Firm* — Oliff PLC

(57) ABSTRACT

A power tool that includes a driving motor and a power transmitting mechanism. The power transmitting mechanism includes a first clutch cam part, a second clutch cam part, clutch teeth, a clutch detecting mechanism and a controller that can control the driving motor in a first control mode in which the driving motor is controlled to rotate at a first rotation speed until before the first and second clutch cam parts are engaged with each other at the clutch teeth and in a second control mode in which the driving motor is controlled to rotate at a second rotation speed higher than the first rotation speed after the first and second clutch cam parts are engaged with each other at the clutch teeth.

4 Claims, 4 Drawing Sheets

(56) References Cited

U.S. PATENT DOCUMENTS

| | | | | |
|---|---|---|---|---|
| 7,234,536 | B2 * | 6/2007 | Scholl et al. | 173/1 |
| 7,398,834 | B2 * | 7/2008 | Jung et al. | 173/4 |
| 7,556,103 | B2 * | 7/2009 | Matsunaga | 173/2 |
| 7,658,239 | B2 * | 2/2010 | Klemm et al. | 173/178 |
| 7,762,349 | B2 * | 7/2010 | Trautner et al. | 173/176 |
| 7,828,074 | B2 * | 11/2010 | Tsubakimoto et al. | 173/178 |
| 7,980,324 | B2 * | 7/2011 | Bixler et al. | 173/176 |
| 7,987,922 | B2 * | 8/2011 | Tokunaga | 173/178 |
| 8,087,474 | B2 * | 1/2012 | Shinma et al. | 173/48 |
| 2007/0034394 | A1 | 2/2007 | Gass et al. | |

FOREIGN PATENT DOCUMENTS

| | | |
|---|---|---|
| JP | A-06-341455 | 12/1994 |
| JP | A-2005-238389 | 9/2005 |
| JP | A-2007-038893 | 2/2007 |

OTHER PUBLICATIONS

May 28, 2014 Office Action issued in Japanese Patent Application No. 2010-290455.

Sep. 11, 2014 Office Action issued in Japanese Patent Application No. 2010-290455 (with English translation).

* cited by examiner

POWER TOOL

BACKGROUND OF THE INVENTION

1. Field of the Invention

The present invention relates to a power tool having a power transmitting mechanism for transmitting power of a driving motor to a tool bit.

2. Description of the Related Art

Japanese laid-open patent publication No. 1993-253854 discloses a screw tightening machine for tightening screws. A power transmitting mechanism of this screw tightening machine has a driving-side member rotationally driven by a driving motor and a driven-side member connected to a tool bit, and transmits power of the driving motor to the tool bit when the driving-side and driven-side members engage with each other via a claw clutch.

In the known screw tightening machine, when the driving-side and driven-side members are engaged with each other via the claw clutch, clutch teeth repeatedly hit each other. Therefore, wear of the clutch teeth may be accelerated so that the product life is shortened.

Therefore, in designing a power tool of this type including a screw tightening machine, an effective technique for preventing wear of a power transmitting part between a driving motor and a tool bit is required.

SUMMARY OF THE INVENTION

Accordingly, it is an object of the present invention to provide an effective technique for preventing wear of parts to be involved in power transmission, in a power tool having a power transmitting mechanism for transmitting power of a driving motor to a tool bit.

In order to solve the above-described problem, a power tool as defined in claims of the present invention is provided.

According to one aspect of the present teachings, a power tool is taught that includes as its components at least a driving motor and a power transmitting mechanism. A tool bit may be a component of the power tool, or it may be a separate component. The driving motor may be an electric or pneumatic motor. The power transmitting mechanism is configured and provided as a mechanism for transmitting power of the driving motor to the tool bit. Further, the power transmitting mechanism includes a driving-side member, a driven-side member, an engagement part, a detecting mechanism and a controller. The driving-side member is rotationally driven by the driving motor. The driven-side member holds the tool bit. The engagement part engages the driving-side member and the driven-side member when the driven-side member is pushed in toward the driving-side member together with the tool bit by user's pressing force. The "engagement" here includes engagement of clutch teeth and engagement by frictional force. The detecting mechanism detects an operating condition of the driven-side member with respect to the driving-side member. The controller can control the driving motor in a first control mode and a second control mode, according to the operating condition of the driven-side member detected by the detecting mechanism. In the first control mode, the driving motor is controlled to rotate at a first rotation speed until before the driving-side and driven-side members are engaged with each other at the engagement part. The first control mode here includes not only a mode in which the rotation speed of the driving motor is controlled to a low, but a mode in which it is controlled to zero. In the second control mode, the driving motor is controlled to rotate at a second rotation speed higher than the first rotation speed after the driving-side and driven-side members are engaged with each other at the engagement part. In addition to the first and second control modes, a further different control mode may be provided.

With the above-described construction, the driving motor is slowly driven at a relatively low speed until just before the driving-side and driven-side members are engaged with each other at the engagement part. Therefore, impact of the engagement of the engagement part can be reduced, so that wear of the engagement part can be reduced. Thus, such construction is effective in preventing decrease of the product life of the power transmitting mechanism.

In another aspect of the present teachings, preferably, the detecting mechanism detects a positional relation between the driving-side member and the driven-side member in order to detect the operating condition of the driven-side member, and according to the positional relation detected by the detecting mechanism, the controller is placed in the second control mode when the driving-side and driven-side members are engaged with each other at the engagement part. Such a construction is effective in accurately detecting engagement of the driving-side and driven-side members according to the positional relation between the driving-side and driven-side members.

In another aspect of the present teachings, preferably, the engagement part comprises clutch teeth (also referred to as "clutch claws") which allow engagement of the driving-side member and the driven-side member with each other. With such a construction, the driving motor is slowly driven at a relatively low speed until just before the clutch teeth engage with each other particularly while repeatedly hitting each other. Therefore, impact of the engagement of the clutch teeth can be reduced, so that wear of the clutch teeth can be reduced.

In another aspect of the present teachings, preferably, the driven-side member has a pushing region provided and configured to detect the position of the driven-side member with respect to the driving-side member. Further, the detecting mechanism has a switch that is placed in an off state when a movable member is in a first set position, and placed in an on state when the movable member is in a second set position. When the driven-side member is pushed in toward the driving-side member and engaged with the driving-side member at the engagement part, the movable member is pushed from the first set position to the second set position by the pushing region. With such a construction, the pushing region formed by part of the driven-side member is used to detect the position of the driven-side member with respect to the drive-side member, so that the structure can be made simpler. Therefore, increase of extra parts which may be caused by increased structural complexity can be prevented.

According to the present invention, in a power tool having a power transmitting mechanism for transmitting power of a driving motor to a tool bit, wear of parts to be involved in power transmission can be prevented. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
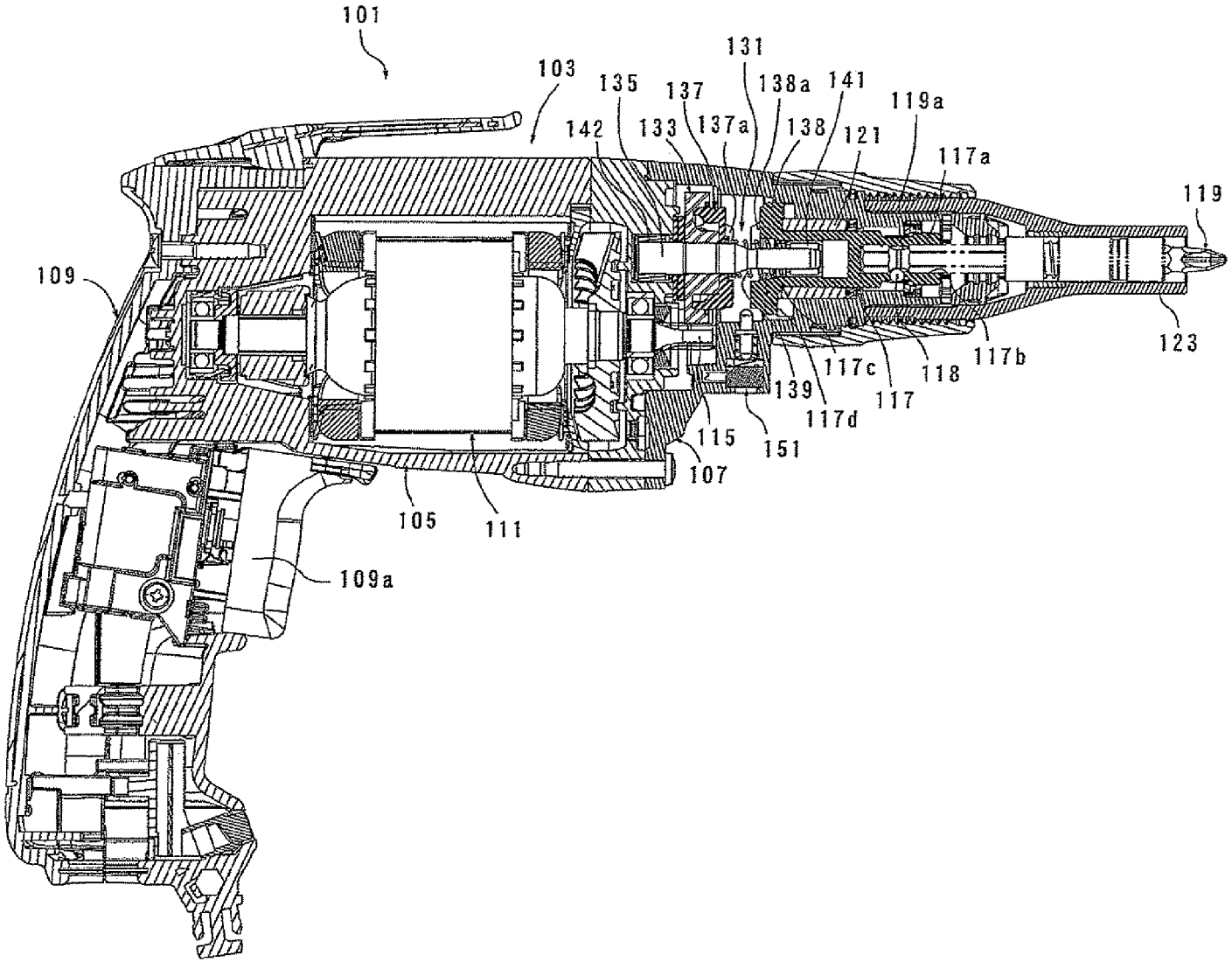
FIG. 1 is a sectional view showing an entire electric screwdriver according to an embodiment of the invention.

A representative embodiment of a power tool according to the present invention is now described with reference to the drawings. In this embodiment, an electric screwdriver is explained as a representative example of the power tool according to the present invention. FIG. 1 shows an entire electric screwdriver 101 (also referred to as a "screw tightening machine") according to this embodiment.

As shown in FIG. 1, the electric screwdriver 101 mainly includes a body 103, a handgrip 109 and a driver bit 119. The body 103 forms a power tool body of the screwdriver 101. The handgrip 109 is connected to the body 103 on the side opposite to the driver bit 119 and forms a handle part to be held by a user. The driver bit 119 is an elongate tool detachably coupled to a front end region (on the right side as viewed in FIG. 1) of the body 103 via an elongate spindle 117. The driver bit 119 may be formed as one component of the screwdriver 101, or it may be formed as a separate component. The driver bit 119 here is a feature that corresponds to the "tool bit" according to the present invention.

In the present embodiment, for the sake of convenience of explanation, the driver bit 119 side in the screwdriver 101 is taken as the front of the power tool or components of the power tool, and the handgrip 109 side as the rear of the power tool or components of the power tool. Further, the horizontal direction in FIG. 1 is taken as the longitudinal direction of the driver bit 119

The body 103 mainly includes a motor housing 105 and a gear housing 107. The motor housing 105 is formed as a housing that houses at least a driving motor (also referred to as an "electric motor") 111. The driving motor 111 is driven when the user operates a trigger 109*a* on the handgrip 109. Specifically, the driving motor 111 is driven when the trigger 109*a* is depressed by the user, and it stops when the trigger 109*a* is released. The driving motor 111 here is a feature that corresponds to the "driving motor" according to the present invention. The gear housing 107 is formed as a housing that houses at least a power transmitting mechanism 131 and a clutch detecting mechanism 151. Further, a locator 123 for regulating the penetration depth of the driver bit 119 is provided on a front end of the body 103.

The spindle 117 is mounted to the gear housing 107, via a bearing 121 which is subjected to radial load in its radial direction, such that it can move in the axial direction of the driver bit 119 and can rotate around the axis of the driver bit 119. The spindle 117 is allowed to move in the axial direction of the driver bit 119 between a predetermined first set position (also referred to as a "pushed-in position") adjacent to the driving gear 133 and a predetermined second set position (also referred to as a "released position" or an "initial position prior to push-in) at a distance away from the driving gear 133. A bit insertion hole 117*b* is formed in a front end portion 117*a* of the spindle 117. The driver bit 119 having a small-diameter portion 119*a* is inserted into the bit insertion hole 117*b*, and a steel ball 118 is biased by a ring-like leaf spring (not shown) and radially engaged with the small-diameter portion 119*a*. In this manner, the spindle 117 holds the driver bit 119.

The power transmitting mechanism 131 has a function of transmitting the rotating output of the driving motor 111 to the spindle 117 and the driver bit 119 and a function as a clutch for interrupting this transmission. The power transmitting mechanism 131 mainly includes a driving gear 133, a drive shaft 135, a first clutch earn part 137, a second clutch cam part 138 and a coil spring 139. The power transmitting mechanism 131 is a feature that corresponds to the "power transmitting mechanism" according to the present invention.

The driving gear 133 is opposed to the second clutch cam part 138 formed on a rear end portion 117*c* of the spindle 117 and integrally formed with the drive shaft 135 and the first clutch cam part 137 in the direction of rotation. The driving gear 133 is configured as a rotating member which engages with a motor shaft 115 of the driving motor 111 and is rotationally driven around the drive shaft 135. The driving gear 133, the drive shaft 135 and the first clutch cam part 137 are drive-side members which are rotationally driven by the driving motor 111 and forms the "drive-side member" according to the present invention.

The drive shaft 135 is configured as a longitudinal member extending coaxially with the driver bit 119. A front end portion of the drive shaft 135 is rotatably supported via a bearing 141 which is subjected to radial load in its radial direction, and a rear end portion of the drive shaft 135 is rotatably supported via a bearing 142 which is subjected to radial load in its radial direction.

Figure 2:
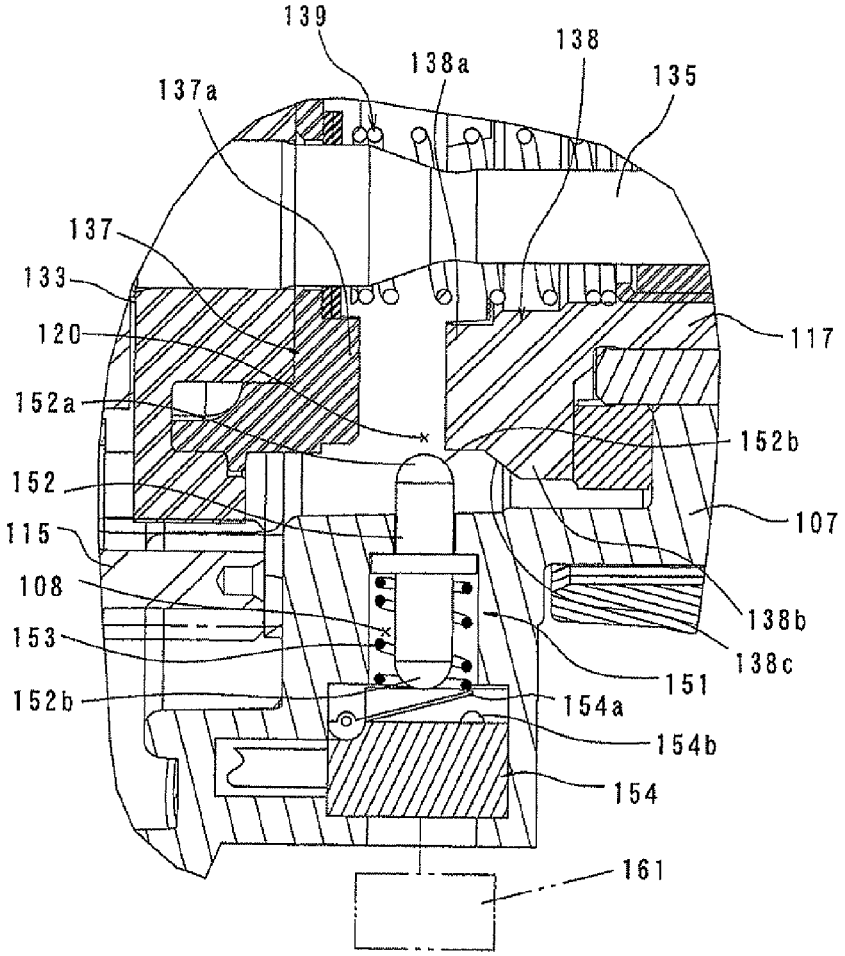
FIG. 2 is a partly enlarged view showing a clutch detecting mechanism 151 in FIG. 1, in a state prior to engagement between clutch teeth 137*a* of a first clutch cam part 137 and clutch teeth 138*a* of a second clutch cam part 138.

The first clutch cam part 137 has clutch teeth (also referred to as "clutch claws") 137*a* in its area opposed to the second clutch cam part 138 on the spindle 117. The second clutch cam part 138 is integrally formed with the spindle 117 and has clutch teeth (also referred to as "clutch claws") 138*a* in its area opposed to the first clutch cam part 137. The second clutch cam part 138 has an extending part (extending part 138*b* which is shown in FIG. 2 and described below) extending from the rear end portion 117*c* of the spindle 117. The second clutch cam part 138 (the spindle 117) has a function of holding the driver bit 119 and forms a "driven-side member" according to the present invention. The clutch teeth 137*a* and the clutch teeth 138*a* can be engaged with each other by movement of the second clutch cam part 138 toward the first clutch cam part 137.

The coil spring 139 is disposed around the drive shaft 135 and housed together with the drive shaft 135 within a spring housing hole 117*d* formed in the spindle 117. The coil spring 139 serves as a compression coil spring to elastically bias the spindle 117 and the driving gear 133 away from each other in the axial direction of the driver bit 119. For this purpose, one end of the coil spring 139 is mounted on the spindle 117 side and the other end is mounted on the driving gear 133 side. Therefore, the coil spring 139 is expanded in length to the fullest extent when the spindle 117 is in the above-described first set position, while it is contracted to the fullest extent when the spindle 117 is in the above-described second set position. The coil spring 139 is expanded and contracted between the first set position and the second set position.

Figure 3:
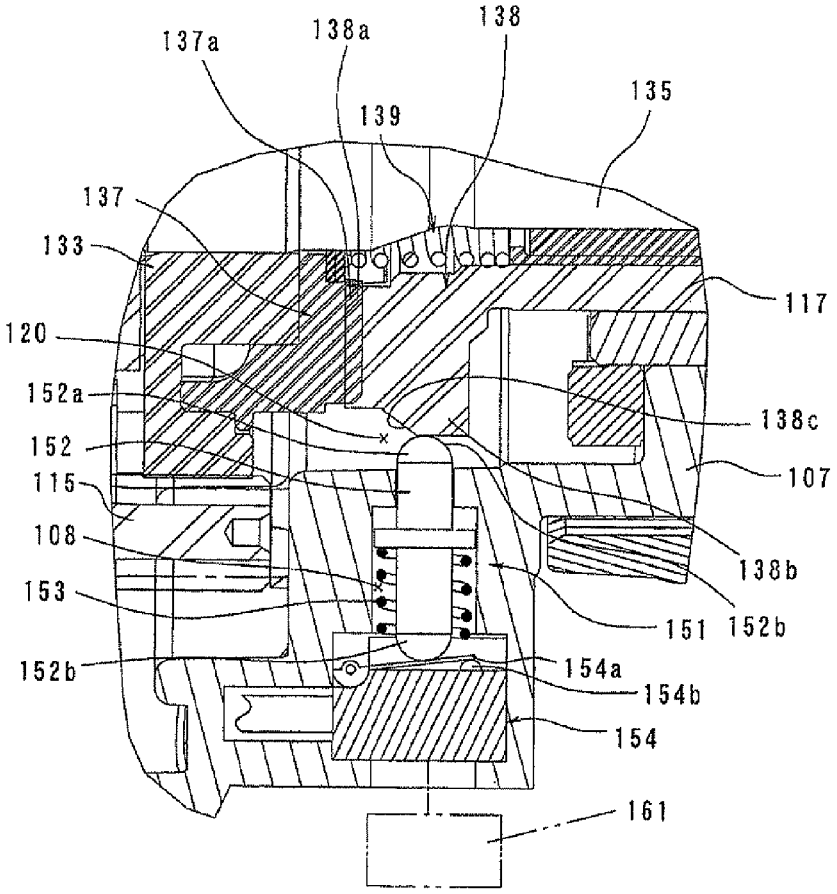
FIG. 3 is also a partly enlarged view showing the clutch detecting mechanism 151 in FIG. 1, in a state of engagement between the clutch teeth 137*a* of the first clutch cam part 137 and the clutch teeth 138*a* of the second clutch cam part 138.

The clutch detecting mechanism 151 serves to detect the operating condition of the second clutch cam part 138 with respect to the first clutch cam part 137, or engagement between the clutch teeth 137*a* of the first clutch cam part 137 and the clutch teeth 138*a* of the second clutch cam part 138. The clutch detecting mechanism 151 here is a feature that corresponds to the "detecting mechanism" according to the present invention. The construction of the clutch detecting mechanism 151 is now specifically described with reference to FIGS. 2 and 3 which are partly enlarged view showing the clutch detecting mechanism 151 in FIG. 1. FIG. 2 shows the state prior to engagement between the clutch teeth 137*a* of the first clutch cam part 137 and the clutch teeth 138*a* of the second clutch cam part 138. FIG. 3 shows the state of engagement between the clutch teeth 137*a* of the first clutch cam part 137 and the clutch teeth 138*a* of the second clutch cam part 138.

As shown in FIG. 2, the clutch detecting mechanism 151 of this embodiment includes a movable member 152, a coil spring 153 and a micro switch 154.

The movable member 152 is configured as an elongate member extending in a direction transverse to the axial direction of a driver bit (the driver bit 119 in FIG. 1), and the movable member 152 is supported by the gear housing 107 and allowed to move in this transverse direction. Although described below in detail, the movable member 152 can move between a first set position shown in FIG. 2 in which a front end 152*a* of the movable member 152 is protruded to the fullest extent into an operating space 120 for the second clutch cam part 138, and a second set position shown in FIG. 3 in which the front end 152*a* is retracted to the fullest extent from the operating space 120. The movable member 152 here is a feature that corresponds to the "movable member" according to the present invention. The set positions of the movable member 152 shown in FIGS. 2 and 3 are features that correspond to the "first set position" and the "second set position", respectively, according to the present invention.

The coil spring 153 is housed within a spring housing hole 108 formed in the gear housing 107 and serves as a compression coil spring to elastically bias the movable member 152 toward the operating space 120 for the second clutch cam part 138. Therefore, the coil spring 139 is expanded in length to the fullest extent when the movable member 152 is in the above-described first set position, while it is contracted to the fullest extent when the movable member 152 is in the above-described second set position. The coil spring 139 is expanded and contracted between the first set position and the second set position.

The micro switch 154 is configured as an electronic switch which is connected to a controller 161 via a harness. The controller 161 controls the driving motor 111 according to the operating conditions of the micro switch 154. The micro switch 154 has a first switch contact 154*a* and a second switch contact 154*b*. The non-contact state between the first switch contact 154*a* and the second switch contact 154*b* is defined as an "off state" of the micro switch 154, while the contact state between the first switch contact 154*a* and the second switch contact 154*b* is defined as an "on state" of the micro switch 154. The micro switch 154 and the controller 161 are features that correspond to the "switch" and the "controller", respectively, according to this invention.

As shown in FIG. 2, when the second clutch cam part 138 is moved away from the movable member 152, the extending part 138*b* of the second clutch cam part 138 is disengaged from the front end 152*a* of the movable member 152. Therefore, in this state, a rear end 152*b* of the movable member 152 does not press the first switch contact 154*a* of the micro switch 154. At this time, the clutch teeth 137*a* of the first clutch cam part 137 and the clutch teeth 138*a* of the second clutch cam part 138 are not in engagement with each other, and the micro switch 154 is in the "off state" in which the first switch contact 154*a* and the second switch contact 154*b* are not in contact with each other. When the micro switch 154 is in the "off state", the controller 161 controls the driving motor 111 to rotate at a first rotation speed. This control mode in which the controller 161 controls the driving motor 111 to rotate at a relatively low first rotation speed is a feature that corresponds to the "first control mode" according to this invention.

As shown in FIG. 3, when the second clutch cam part 138 is moved toward the movable member 152 and the extending part 138*b* of the second clutch cam part 138 is engaged with the front end 152*a* of the movable member 152, the rear end 152*b* of the movable member 152 presses the first switch contact 154*a* of the micro switch 154. At this time, the clutch teeth 137*a* of the first clutch cam part 137 and the clutch teeth 138*a* of the second clutch cam part 138 are in engagement with each other, and the micro switch 154 is in the "on state" in which the first switch contact 154*a* and the second switch contact 154*b* are in contact with each other. Specifically, when the front end 152*a* of the movable member 152 is engaged with the extending part 138*b* of the second clutch cam part 138, the movable member 152 is pushed by the extending part 138*b* against the biasing force of the coil spring 153 and moved toward the first switch contact 154*a*. When the micro switch 154 is in the "on state", the controller 161 controls the driving motor 111 to rotate at a second rotation speed higher than the first rotation speed. This control mode in which the controller 161 controls the driving motor 111 to rotate at the relatively high second rotation speed is a feature that corresponds to the "second control mode" according to this invention.

Thus, the clutch detecting mechanism 151 of this embodiment is provided and configured to detect whether the clutch teeth 137*a* and 138*a* are engaged with each other or not, according to the positional relation between the first clutch cam part 137 and the second clutch cam part 138. Further, in this embodiment, the extending part 138*b* is provided and configured as a pushing region in order to detect the position of the second clutch cam part 138 with respect to the first clutch cam part 137. When the movable member 152 is pushed by the extending part 138*b*, the movable member 152 is moved from the first set position shown in FIG. 2 to the second set position shown in FIG. 3. Therefore, the extending part 138*b* here is a feature that corresponds to the "pushing region" according to this invention.

As shown in FIGS. 2 and 3, the extending part 138*b* preferably includes an inclined surface 138*c* in the pushing region for pushing the movable member 152. Further, as shown in FIGS. 2 and 3, the front end 152*a* of the movable member 152 preferably includes a circular arc (spherical) surface 152*b* in a region of contact with the extending part 138*b*. With such a construction, when the movable member 152 is pushed by the extending part 138*b*, the movable member 152 is moved as smoothly sliding on the inclined surface 138*c* of the extending part 138*b* by cooperation between the inclined surface 138*c* of the extending part 138*b* and the circular arc surface 152*b* of the front end 152*a*. Thus, this construction is effective in realizing smooth movement of the movable member 152.

Operation of the electric screwdriver 101 having the above-mentioned construction is now explained with reference to FIGS. 2 and 3. FIG. 2 shows an initial state in which a screw tightening operation is not yet started. In this initial state, the spindle 117 is biased and held in a forward (rightward as viewed in FIG. 2) position by the elastic biasing force of the coil spring 139. In this state, the rotating output of the first clutch cam part 137 is not transmitted to the spindle 117. Thereafter, when the trigger 109*a* is depressed, the driving motor 111 is driven. At this time, however, the micro switch 154 is in the off state. Therefore, the controller 161 controls the driving motor 111 to be driven at the predetermined first rotation speed. Further, the first clutch cam part 137 is driven at a rotation speed appropriate to a gear ratio predetermined in the power transmitting mechanism 131, with respect to the first rotation speed of the driving motor 111. At this time, the driving gear 133 is rotationally driven via the motor shaft 115 of the driving motor 111. The first clutch cam part 137 is however located away from the second clutch cam part 138 and the clutch teeth 137*a* and 138*a* are not in engagement with each other. Therefore, the spindle 117 is not rotationally driven and the screwdriver 101 idles.

In this idling state, when a screw (not shown) attached to the driver bit 119 is pressed against a workpiece by user's pressing force in order to actually perform a screw tightening operation, the spindle 117 is pushed rearward (leftward as viewed in FIG. 2) together with the driver bit 119 against the elastic biasing force of the coil spring 139. By pushing in the spindle 117, the second clutch cam part 138 moves toward the first clutch cam part 137 and the clutch teeth 138*a* are engaged with the clutch teeth 137*a*. The clutch teeth 137*a* and 138*a* are engagement parts at which the first and second clutch cam parts 137 and 138 are engaged with each other by pushing in the spindle 117 together with the driver bit 119 toward the driving gear 133. The clutch teeth 137*a* and 138*a* form the "engagement part" and the "clutch teeth" according to this invention. After this engagement, the micro switch 154 is switched from the off state to the on state, so that the controller 161 controls the driving motor 111 to be driven at the predetermined second rotation speed higher than the first rotation speed. Further, the first clutch cam part 137, the second clutch cam part 138, the spindle 117 and the driver bit 119 are driven at a rotation speed appropriate to the gear ratio predetermined in the power transmitting mechanism 131, with respect to the second rotation speed of the driving motor 111.

By the above-described driving control, the driving motor 111 and the first clutch cam part 137 are slowly driven at a relatively low speed until just before the clutch teeth engage with each other while repeatedly hitting each other. Therefore, impact of the engagement of the clutch teeth can be reduced, so that wear of the clutch teeth can be reduced. Thus, such control is effective in preventing decrease of the product life of the power transmitting mechanism 131. After engagement of the clutch teeth, the driving motor 111 and the first clutch cam part 137 are driven at a relatively high speed. Then the rotating output of the driving motor 111 is transmitted to the spindle 117 and the driver bit 119 via the power transmitting mechanism 131, and a screw tightening operation is actually performed in a desired manner via the driver bit 119. In order to finish the screw tightening operation, the driving motor 111 is stopped by releasing the trigger 109*a*.

Figure 4:
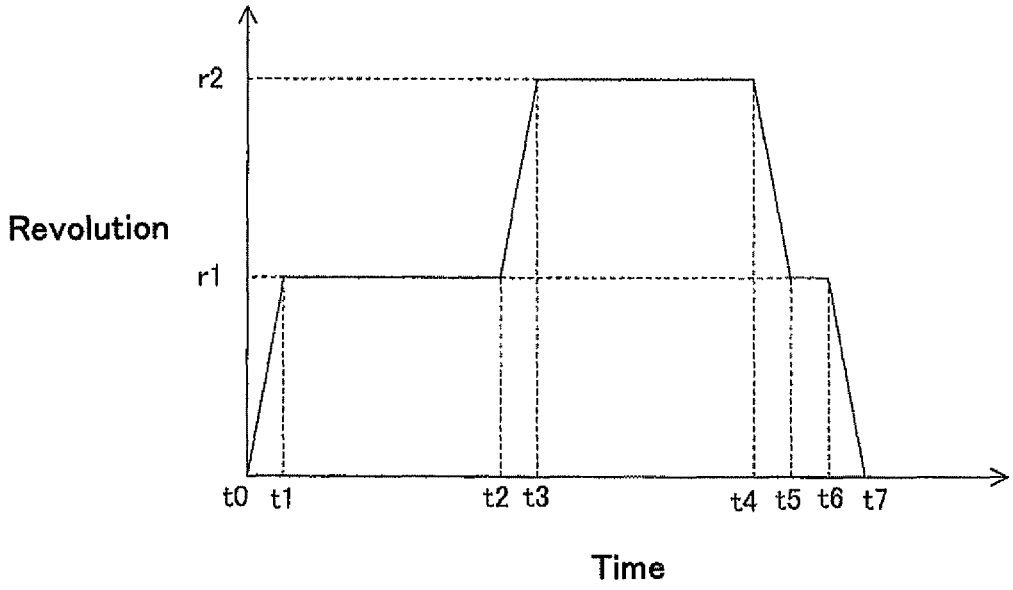
FIG. 4 is a graph showing time-varying output rotation speed in a first embodiment.
Figure 5:
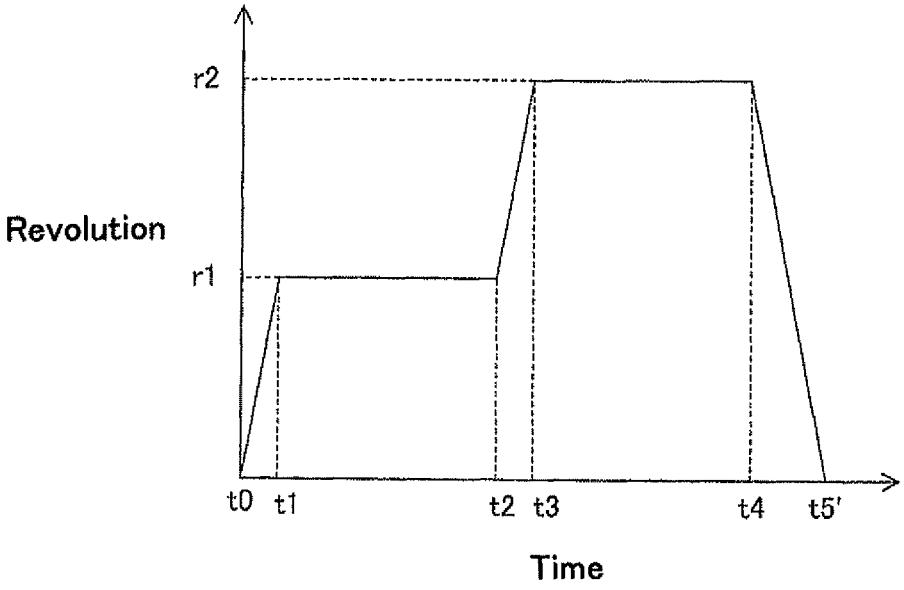
FIG. 5 is a graph showing time-varying output rotation speed in a second embodiment.

As the above-described rotation speed control by the controller 161, for example, first and second embodiments of rotation speed control as described below can be applied. FIGS. 4 and 5 show the time-varying output rotation speed in the first and second embodiments, respectively. The rotation speed shown in the drawings is defined as output rotation speed of the driving motor 111 or the first clutch cam part 137.

In the rotation speed control shown in FIG. 4, depressing the trigger is started at time t0, and the rotation speed reaches r1 at time t1. In a subsequent idling state, a driving motor (the driving motor 111 in FIG. 1) is controlled to be driven at the low rotation speed r1. Thereafter, the rotation speed r1 is maintained until just before clutch teeth (the clutch teeth 137*a*, 138*a* in FIG. 1) are engaged with each other by pressing a driver bit (the driver bit 119 in FIG. 1). The driving motor is controlled such that the rotation speed is increased from r1 to r2 between time t2 and time t3 after the clutch teeth are engaged with each other at time t2, and in an actual screw tightening operation, the high rotation speed r2 is maintained. The rotation speed r1 and the rotation speed r2 here are features that correspond to the "first rotation speed" and the "second rotation speed", respectively, according to this invention. When the clutch teeth are disengaged from each other by releasing (stopping pressing) the driver bit in order to finish the screw tightening operation, the driving motor is controlled such that the rotation speed is decreased from r2 to r1 between time t4 and time t5 and the rotation speed is maintained at r1 from time t5. Specifically, the above-described micro switch is placed in the on state between time t2 and time t4. Further, the driving motor is controlled to stop by releasing the trigger at time t6, and finally the rotation speed is decreased to zero at time t7. By such control, the state in which the rotation speed is maintained at r1 between time t5 and time t6 is effective as a standby state for a next screw tightening operation. In this standby state, a fan-type cooling device (not shown) can also be driven by the driving motor, as necessary.

The rotation speed control shown in FIG. 5 is different from the rotation speed control shown in FIG. 4 only when the screw tightening operation is finished. In this rotation speed control, when the clutch teeth are disengaged from each other by releasing the driver bit, the rotation speed is decreased from r2 to zero between time t4 and time t5'. Specifically, the driving motor is controlled to stop upon release of the driver bit and not upon release of the trigger. Such control is effective in reducing power consumption.

In the rotation speed controls shown in FIGS. 4 and 5, as described above, the rotation speed is controlled to be maintained at r1 until just before the clutch teeth are engaged with each other by pressing the driver bit, and after engagement of the clutch teeth, the rotation speed is increased from r1 to r2. As for the timing of change of the rotation speed, other manners of control may be applied. For example, it may be controlled such that the rotation speed is maintained at zero until just before engagement of the clutch teeth, and at the beginning of engagement of the clutch teeth, the rotation speed is increased to r1, and after complete engagement of the clutch teeth, the rotation speed is increased from r1 to r2. In this case, a control mode in which the rotation speed is controlled to zero, and a control mode in which the rotation speed is controlled to r1 correspond to the "first control mode" and the "second control mode", respectively, according to this invention. In this control, it is preferable to provide a detecting mechanism which can detect the position of the driven-side member with respect to the drive-side member at the beginning and completion of engagement of the clutch teeth.

Other Embodiments

The present invention is not limited to the above embodiment, but rather, may be added to, changed, replaced with alternatives or otherwise modified. For example, the following provisions can be made in application of this embodiment.

In the above-described embodiment, the rotation speed of the driving motor 111 is described as being controlled to be changed according to the positional relation between the first and second clutch cam parts 137 and 138. In this invention, however, the rotation speed of the driving motor 111 may be controlled to be changed, for example, according to the spring load acting on the coil spring 139 when the spindle 117 is pushed in.

Further, in this embodiment, the rotation speed of the driving motor 111 is described as being controlled in two control modes of low-speed rotation and high-speed rotation, but in this invention, a further different control mode may be provided.

Further, in this embodiment, the present invention is described as being applied to the power transmitting mechanism utilizing engagement of the clutch teeth between the drive-side and driven-side members, but the present invention may also be applied to a power transmitting mechanism utilizing engagement by frictional force, instead of engagement of the clutch teeth.

Further, in this embodiment, the present invention is described as being applied to the power transmitting mechanism of the electric screwdriver, but the present invention may also be applied to other power tools having a power transmitting mechanism for transmitting power of the driving motor to a tool bit. In this case, the driving motor is not limited to an electric motor, but it may be a pneumatic motor.

DESCRIPTION OF NUMERALS

100 electric screwdriver
103 body
105 motor housing
107 gear housing
108 spring housing hole
109 handgrip
109*a* trigger
111 driving motor
115 motor shaft
117 spindle
117*a* front end portion
117*b* bit insertion hole
117*c* rear end portion
117*d* spring housing hole
118 steel ball
119 driver bit
119*a* small-diameter portion
120 operating space
121 bearing
123 locator
131 power transmitting mechanism
133 driving gear
135 drive shaft
137 first clutch cam part
137*a* clutch teeth
138 second clutch cam part
138*a* clutch teeth
138*b* extending part (pushing region)
138*c* inclined surface
139 coil spring
141, 142 bearing
151 clutch detecting mechanism
152 movable member
152*a* front end
152*b* circular arc (spherical) surface
153 coil spring
154 micro switch
154*a* first switch contact
154*b* second switch contact
161 controller

What we claim is:

1. A power tool comprising a driving motor and a power transmitting mechanism to transmit power of the driving motor to a tool bit to perform a predetermined operation on a workpiece via the tool bit, wherein:

the power transmitting mechanism includes:

a driving-side member that is rotationally driven by the driving motor, a driven-side member that holds the tool bit, an engagement part that engages the driving-side member and the driven-side member when the driven-side member is pushed in toward the driving-side member together with the tool bit by user's pressing force, a detecting mechanism that detects an operating condition of the driven-side member with respect to the driving-side member, and a controller that can control the driving motor, according to the operating condition of the driven-side member detected by the detecting mechanism, in a first control mode in which the driving motor is controlled to rotate at a first rotation speed greater than zero before the driving-side and driven-side members are engaged with each other at the engagement part, and in a second control mode in which the driving motor is controlled to rotate at a second rotation speed higher than the first rotation speed after the driving-side and driven-side members are engaged with each other at the engagement part.

2. The power tool as defined in claim 1, wherein the detecting mechanism detects a positional relation between the driving-side member and the driven-side member in order to detect the operating condition of the driven-side member, and according to the positional relation detected by the detecting mechanism, the controller is placed in the second control mode when the driving-side and driven-side members are engaged with each other at the engagement part.

3. The power tool as defined in claim 2, wherein the engagement part comprises clutch teeth which allow engagement of the driving-side member and the driven-side member with each other.

4. The power tool as defined in claim 2, wherein the driven-side member has a pushing region provided and configured to detect the position of the driven-side member with respect to the driving-side member, and wherein the detecting mechanism has a switch that is placed in an off state when a movable member is in a first set position, and placed in an on state when the movable member is in a second set position, and when the driven-side member is pushed in toward the driving-side member and engaged with the driving-side member at the engagement part, the movable member is pushed from the first set position to the second set position by the pushing region.

* * * * *